United States Patent [19]

Rahn

[11] 4,149,058

[45] Apr. 10, 1979

[54] SUCCESSIVE WELDING OF IMMEDIATELY CONSECUTIVE CHAIN LINKS

[75] Inventor: Paul Rahn, Cologne, Fed. Rep. of Germany

[73] Assignee: Meyer, Roth & Pastor Maschinenfabrik GmbH, Cologne, Fed. Rep. of Germany

[21] Appl. No.: 820,013

[22] Filed: Jul. 28, 1977

[51] Int. Cl.[2] ..... B23K 11/02

[52] U.S. Cl. ..... 219/51; 59/34; 219/52

[58] Field of Search ..... 219/51, 52; 59/22, 31, 59/33, 34; 228/49 R, 192

[56] References Cited

U.S. PATENT DOCUMENTS

| | | | |
|---|---|---|---|
| 1,023,127 | 4/1912 | Ryan | 219/51 |
| 1,975,753 | 10/1934 | Delano | 219/51 X |
| 2,464,875 | 3/1949 | Lewis | 219/51 |
| 3,552,118 | 1/1971 | Reiter | 59/31 X |
| 3,934,407 | 1/1976 | Lange | 219/51 X |
| 4,012,618 | 3/1977 | Ebel | 219/51 X |

*Primary Examiner*—Richard R. Kucia
*Attorney, Agent, or Firm*—Spencer & Kaye

[57] ABSTRACT

For the successive welding to immediately consecutive links of a chain at a welding station, the chain is advanced to bring each link in turn to the welding station, the links flanking the link to be welded are positioned in a common plane perpendicular to the orientation of the link to be welded by orienting edges of two guides disposed to respectively opposite sides of the welding station, and each guide is constituted by a pair of webs spaced from its respective orienting edge, and arranged to support the straight sides of alternating chain links, and a region between the webs and the orienting edge in which the chain is free to rotate or twist about its longitudinal axis.

3 Claims, 6 Drawing Figures

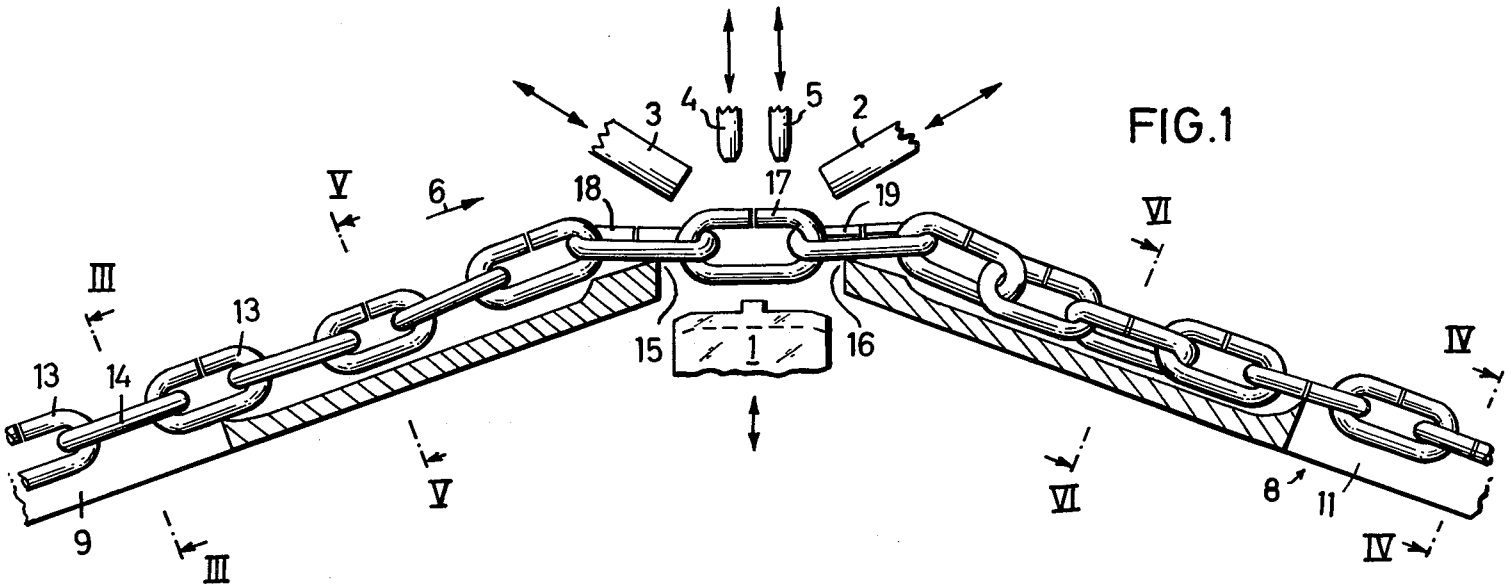
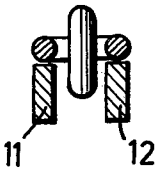
FIG.4
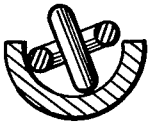
FIG.6
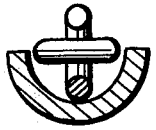
FIG.5
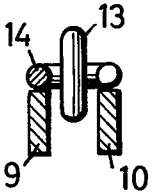
FIG.3

SUCCESSIVE WELDING OF IMMEDIATELY CONSECUTIVE CHAIN LINKS

BACKGROUND OF THE INVENTION

The present invention relates to an apparatus for successively electrically welding immediately successive links of a chain.

Apparatus of this type generally includes welding electrodes and upsetting tools at a welding station, and a saddle located underneath the welding station for supporting the chain link to be welded as well as guides which are associated with the welding station, one guide being provided for the incoming chain portion and sloping upwardly toward the welding station and another guide being provided for the outgoing chain portion and sloping downwardly away from the welding station. Each guide, at that end thereof which is adjacent the welding station has an orienting edge which engages between the two straight, longitudinal sides of a respective one of the two chain links which flank the chain link about to be welded.

An apparatus of the above-described type makes it possible to weld the links of a link chain formed of pre-bent chain links in a successive manner, i.e., one link after the other. The turning of the next link on which the welding operation is about to be performed is effected practically without moving components because even the weight of the link chain portions extending to both sides of the chain link about to be welded or an additionally applied tensioning force is sufficient to urge the straight sides of each of the two chain links flanking the link about to be welded against the orienting edge of its respective guide so that both of these chain links come to lie in a common plane. As a result, the chain link which is to be welded aligns itself at an angle of 90° to this common plane so that the chain link to be welded need only be lifted into the welding position by means of a saddle, which is preferably lockable in the operational position, and positioned by the upsetting tools firmly on the saddle before the welding electrodes are applied to the ends of the chain link about to be welded. Such apparatus is disclosed in U.S. Pat. No. 4,012,618, issued to Bruno Ebel, Günter Krumholz and Paul Rahn on Mar. 15, 1977.

SUMMARY OF THE INVENTION

It is an object of the invention to provide improved guidance of the chain portions adjoining the welding station so that conventional devices for advancing the chain on the guides in a timed relationship with the welding operation of the machine can be used.

The above and other objects are accomplished according to the invention by providing each guide, starting from that end which is remote from the welding station, with two parallel webs, on which, in an alternating manner, one chain link is guided in an upright position whereas the other chain link is guided in a flat lying position and further, which webs terminate at a distance from the orienting edges of the associated guide. If now the length of chain associated with the welding station is positioned in the apparatus in such a manner that, for example, on the guide for the incoming chain portion the length of chain extending between the welding station and the end of the webs of that guide is twisted by 90° about the longitudinal chain axis, whereby those chain links guided in an upright position between the webs are arranged in such a manner that the joint to be welded is above the guiding plane, whereas the chain portion at the outlet side is guided in an untwisted manner, it will then occur during advance under the effect of a tensioning force in the longitudinal direction of the chain, on the one hand, and under the influence of the two orienting edges, on the other hand, that the previously twisted length portion at the inlet side will be untwisted and become aligned into the orientation predetermined by the webs of the inlet guide and thus the link which was previously just ahead of the welding station and was horizontally oriented will be brought into a vertical orientation. On the guide at the outlet side, the chain portion at this time has a longitudinal twist between the orienting edge, on the one hand, and the end of the associated webs closest to that orienting edge, on the other hand.

In successive welding cycles the process is repeated in the reverse order so that again the chain portion at the inlet side is twisted and the chain portion at the outlet side is arranged in the guides in an untwisted manner.

It is quite feasible here to leave the space between the end of the webs closest to the associated orienting edge, on the one hand, and the orienting edge, on the other hand, without any additional guide, apart from a corresponding feed-in zone in the range of the orienting edge.

In accordance with a particularly advantageous further feature of the invention, each guide is constructed so that the distance between its orienting edge and the ends of the webs closest to the orienting edge corresponds at least to the length of chain of the type to be welded which is necessary for effectuating a 90° twist. In this manner it is ensured that, under the influence of the applied tensioning force, the resetting forces which are established, based on the shape of the chain links and the twist, support the rotational movement effected by the orienting edge through the application of a torque active about the longitudinal axis of the chain and acting on the chain length portion, and thus bring about a predetermined rotation. This ensures that during the chain advance the chain link to be welded is brought into the welding position at all times with a freely positioned joint.

In accordance with a further advantageous feature of the invention, each guide is provided, between its orienting edge and the end of the webs closest to that edge, with a trough-shaped channel having an interior cross section of approximately semi-circular shape. This assures that even in this intermediate zone there is achieved a perfect guidance of the chain length portion without adversely affecting the twisting motion imparted to the chain during operation.

In accordance with a further advantageous feature of the invention, that portion of each guide which is provided with a web is displaceable and adjustable in in the longitudinal direction of the chain and, advantageously, the two webs of each guide are adjustable with respect to the distance between one another. This permits adaptation of the guides to different chain link sizes in a simple manner without requiring replacement of the guides in their entirety.

BRIEF DESCRIPTION OF THE DRAWINGS

FIG. 1 is an elevational, cross-sectional view of a preferred embodiment of the invention, taken through the chain guide zone of a welding machine.

FIGS. 3, 4, 5 and 6 are cross-sectional views taken along the lines III—III, IV—IV, V—V, and VI—VI, respectively, of FIG. 1.

DESCRIPTION OF THE PREFERRED EMBODIMENTS

Figure 2:
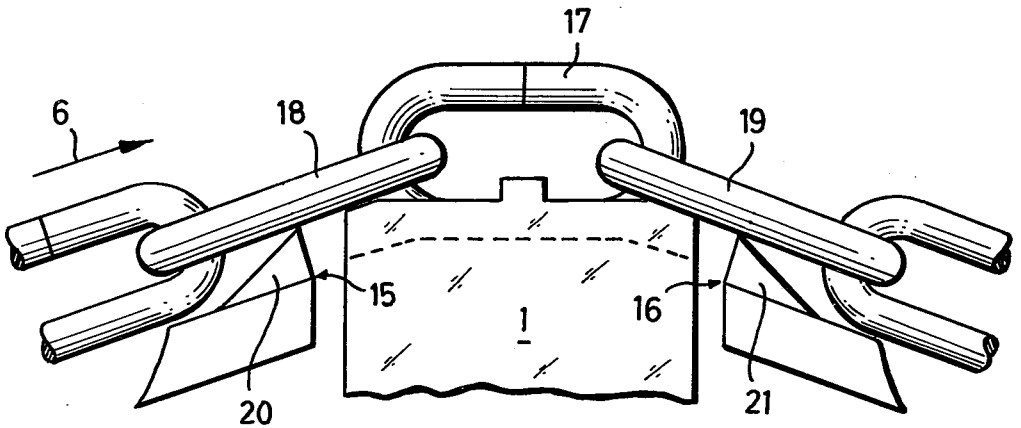
FIG. 2 is an elevational detail view, to an enlarged scale, of a portion of the FIG. 1 structure, showing the chain in the welding position.

Referring first to FIG. 1 in particular, in a machine frame (not shown) of a welding machine of conventional construction, there is provided a welding station located above a vertically movable saddle 1 and composed of upsetting tools 2 and 3 and two electrodes 4 and 5 preferably designed as a pair. Such an arrangement is disclosed, for example, in U.S. Pat. No. 4,012,618. The upsetting tools and the electrodes are of conventional movable structure, their movements being indicated by the double-headed arrows on FIG. 1, so that they may be applied to the chain link brought into the welding position by the saddle 1.

In the direction of chain advance, indicated by the arrow 6, a chain guide 7 is disposed upstream, or ahead, of the saddle and a chain guide 8 is disposed downstream of, or behind, the saddle. Each guide is constructed so that, beginning at its end which is remote from the welding station it is provided with two parallel webs 9 and 10, or 11 and 12, which are so spaced from one another that in each instance the vertically oriented alternate chain links 13 can be freely pulled through between the webs whereas the intervening horizontally oriented chain links 14 engage with both straight sides, or legs, upon the webs at both sides.

Each of guides 7 and 8 has at its end located immediately adjacent the saddle 1 an orienting edge 15 or 16, respectively. This edge is oriented at 90° to the direction of motion of the saddle, indicated by the double arrows in FIG. 1. Thus, in case of a conventional vertically movable saddle, the orienting edges 15 and 16 extend horizontally. The distance of each of orienting edges 15 and 16 from the saddle is selected so that sufficient space is provided to ensure that the chain link 17 about to be welded can position itself freely over the saddle 1 and each of the two flanking chain links 18 and 19 can lie flat on a respective one of orienting edges 15 and 16. This operation will be described in detail below.

The webs 9 and 10 and the webs 11 and 12 terminate, at the ends closer to the welding station at a distance from their respective orienting edges 15 and 16 such that the particular chain type to be welded may be twisted in this intermediate space about its longitudinal axis by 90°. It is expedient in this connection to provide this intermediate space, which in fact can be left without any guide elements so that the chain is guided through a free space, with a trough-shaped guide section which has preferably an interior cross section of semi-circular shape, as illustrated in FIGS. 5 and 6.

The illustrated apparatus operates as follows:

As illustrated in FIG. 1 the saddle 1 is initially in its lowered position so that the chain portion can, by means of a conventional chain advancing device, move to such an extent that the chain link 17 about to be welded arrives at a position underneath the welding station. FIG. 1 shows the position for the individual chain links on both the inlet side and the outlet side of the welding station just before termination of the chain advancing stroke. As soon as the chain advancing stroke is completed, the two flanking links 18 and 19 lie, with the plane formed by their straight sides, fully on the orienting edges 15 and 16, respectively.

Under the influence of the orienting effect of the orienting edges, on the one hand, and the force exerted on the chain portion in the direction of advance, on the other hand, the two flanking chain links 18 and 19 orient the chain link 17 about to be welded in an upright position. Then, by means of a conventional lifting device, the saddle 1 is raised to such an extent that the chain link 17 about to be welded is lifted into the position shown to an enlarged scale in FIG. 2. The two flanking links 18 and 19 at the same time assume correspondingly inclined positions.

Since both guides are inclined at an angle of preferably 20° to the horizontal, the flanking links 18 and 19 exert an optimal aligning force on the chain link 17 about to be welded so that the latter is for all practical purposes oriented accurately in a vertical position in the saddle 1 without additional aligning and supporting elements, as shown in FIG. 2.

Subsequently, the upsetting tools 2 and 3 and the electrodes 4 and 5 are brought into engagement with the chain link 17. Subsequent to the welding process first the electrodes and, after a delay determined by the welding conditions, then the upsetting tools are withdrawn. Then the saddle is lowered and thus the welded chain link 17 is released.

Since the chain has been positioned in the guide in such a manner that one portion has been twisted by 90°—in FIG. 1 this is the portion at the outlet side disposed between the orienting edge 16 and the beginning of the webs 11 and 12, upon the subsequent chain advancing stroke, under the influence of that twist a torque is exerted on the chain portion formed by the chain links 17, 18 and 19 in the zone of the welding station. As a result the just welded chain link 17 rotates clockwise as viewed in the direction of chain advance, that is the welded joint which was positioned at the top moves in front of the plane of the drawing and assumes a horizontal orientation with both of its straight, longitudinal sides extending horizontally and lying on the orienting edge 16. By virtue of this rotation of link 17, it is now the next succeeding chain link 18 which assumes an upright position while the chain portion at the inlet side becomes twisted by 90° in the intermediate zone between the webs 9 and 10 and the orienting edge 15.

During this process, the chain portion at the outlet side becomes untwisted so that the individual chain links are so oriented that they alternatingly stand upright and lie flat in the zone between orienting edge and webs 11 and 12.

Upon completion of the welding of chain link 18, the subsequent chain advance stroke again brings the chain into the orientation shown in FIG. 1, that is the individual links at the inlet side are oriented, alternatingly, in upright and flat lying positions, while the chain portion at the outlet side is again twisted by 90°. As a result, the chain is positioned in the guides in such a manner that at the inlet side the gap, or weld groove, of each essentially flat lying chain link 14 is situated at that side which is directed away from an observer of FIG. 1, while the resulting welded joint of each flat lying link at the outlet side is located at that side which is directed towards the observer. Each link which lies flat on webs 9 and 10 at the inlet side stands upright between webs 11 and 12 at the outlet side, i.e., the chain has a net twist of 90° between inlet webs 9 and 10 and outlet webs 11 and 12.

As may be seen from the enlarged illustration in FIG. 2, in the zones of the orienting edges 15 and 16 there are, in addition, arranged respective orienting elements 20 and 21, each having the form of a wedge tapering from the orienting edge toward the webs of its associated guide.

Each orienting element has lateral flanks sloping downwardly toward the lateral edges of its associated guide. The lateral flanks provide for an accurate transposition and positioning of the longitudinal chain link sides on the orienting edge 15 or 16 during each chain advance stroke. The maximum width of each orienting element is made smaller than the inside width of each chain link so straight sides of the chain links flanking the link to be welded lie securely on the orienting edges 15 and 16. Elements 20 and 21 can have the form shown for elements 33 and 33' in FIGS. 4 and 7 of U.S. Pat. No. 4,012,618.

In case chains having different dimensions are to be welded on the welding machine described above, the webs are so constructed that the distance between the webs of each pair can be varied. It is similarly advantageous to construct each pair of webs to permit variation of the distance of the webs from their associated orienting edges, i.e., to permit displacement of the webs in their longitudinal direction, for a machine intended to weld chains having a large range of sizes.

It will be understood that the above description of the present invention is susceptible to various modifications, changes and adaptations, and the same are intended to be comprehended within the meaning and range of equivalents of the appended claims.

What is claimed is:

1. In a chain welding apparatus for electrically welding the joint of each link of a selected chain in succession, and including a welding station provided with welding electrodes and upsetting tools, a saddle located beneath the welding station for supporting a chain link to be welded, first guide means disposed upstream of the welding station for guiding a length of chain toward the welding station and defining a chain guide path that slopes upwardly toward the welding station, and second guide means disposed downstream of the welding station for guiding a length of chain away from the welding station and defining a chain guide path that slopes downwardly away from the welding station, each of the guide means presenting, at the end thereof directed toward the welding station, an orienting edge for supporting the straight sides of a respective chain link flanking that link presently at the welding station, each guide means including a pair of mutually parallel webs extending along the chain guide path of its associated guide means and spaced apart laterally of that chain guide path for supporting alternate chain links in a reclining position and intervening chain links in an upright position, with the end of the pair of webs which is nearest the orienting edge of its associated guide means being spaced a selected distance along the chain guide path from that orienting edge, the improvement wherein the selected distance between said end of each said web pair and said orienting edge of its associated guide means corresponds at least to that length of the selected chain which is required for the selected chain to execute a twist of 90° and each said guide means further comprises a trough-like channel having an internal cross section of approximately semi-circular shape and extending between said orienting edge and said web pair of its associated guide means.

2. An arrangement as defined in claim 1 wherein each said pair of webs is displaceable along its associated chain guide path.

3. An arrangement as defined in claim 1 wherein the lateral spacing between said webs of each said pair is adjustable.

* * * * *